US006196321B1

(12) United States Patent
Gano

(10) Patent No.: US 6,196,321 B1
(45) Date of Patent: Mar. 6, 2001

(54) WYE BLOCK HAVING AUTOMATICALLY ALIGNED GUIDE STRUCTURE

(75) Inventor: John C. Gano, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/240,547

(22) Filed: Jan. 29, 1999

(51) Int. Cl.[7] ..... E21B 19/00

(52) U.S. Cl. ..... 166/313; 166/50; 166/381; 166/242.1

(58) Field of Search ..... 166/313, 50, 117.6, 166/384, 381, 242.1

(56) References Cited

U.S. PATENT DOCUMENTS

| | | | |
|---|---|---|---|
| 2,488,931 | 11/1949 | Penick . | |
| 3,442,327 | 5/1969 | Graff . | |
| 3,960,366 | 6/1976 | Abney et al. . | |
| 4,133,418 | 1/1979 | Van Bilderlbeek . | |
| 4,291,724 | 9/1981 | Miller . | |
| 4,440,222 | 4/1984 | Pullin . | |
| 5,129,459 | 7/1992 | Breese et al. . | |
| 5,311,936 | 5/1994 | McNair et al. . | |
| 5,377,762 | 1/1995 | Turner . | |
| 5,427,177 | 6/1995 | Jordan, Jr. et al. . | |
| 5,454,430 | 10/1995 | Kennedy et al. . | |
| 5,474,131 | 12/1995 | Jordan, Jr. et al. . | |
| 5,566,763 | 10/1996 | Williamson et al. . | |
| 5,685,373 * | 11/1997 | Collins et al. | 166/313 |
| 5,732,773 | 3/1998 | Parks et al. . | |
| 5,941,307 * | 8/1999 | Tubel | 166/313 |
| 5,944,107 * | 8/1999 | Ohmer | 166/313 |
| 5,944,109 * | 8/1999 | Longbottom | 166/313 |
| 5,960,873 * | 10/1999 | Alexander et al. | 166/50 |
| 6,053,254 * | 4/2000 | Gano | 166/117.6 X |

FOREIGN PATENT DOCUMENTS

| | | |
|---|---|---|
| 0884450 A2 | 12/1998 | (EP) . |
| 2286000 | 8/1995 | (GB) . |
| 2312696 | 11/1997 | (GB) . |

OTHER PUBLICATIONS

European Search Report Appl. #GB0001908.3.

* cited by examiner

*Primary Examiner*—Eileen D. Lillis
*Assistant Examiner*—John Kreck
(74) *Attorney, Agent, or Firm*—William M. Imwalle; Marlin R. Smith

(57) ABSTRACT

A subterranean well completion system and associated methods of servicing wells provide convenient access to selected ones of multiple tubing strings installed in wells. In a described embodiment, a completion system includes a wye block device which has an access control assembly separately conveyed into a housing assembly installed in a well. The access control assembly is conveyed into the housing assembly when it is desired to access a selected one of multiple tubing strings attached to the housing assembly.

27 Claims, 9 Drawing Sheets

WYE BLOCK HAVING AUTOMATICALLY ALIGNED GUIDE STRUCTURE

BACKGROUND OF THE INVENTION

The present invention relates generally to subterranean well systems having multiple tubular strings installed therein and, in one embodiment described herein, more particularly provides a dual string completion system utilizing an improved wye block.

It is well known in the art to interconnect an upper tubular string to multiple lower tubular strings in a subterranean well utilizing a device known as a wye block. The wye block typically has an upper threaded connection for attachment to the upper tubular string, and multiple lower threaded connections for attachment to the multiple lower tubular strings. In this manner, fluid communication is established between the upper tubular string and each of the multiple lower tubular strings so that, for example, fluids from different formations or zones intersected by the well and produced through corresponding ones of the multiple lower tubular strings may be flowed to the earth's surface via the upper tubular string.

The wye block derives its name from the fact that it has a generally Y-shaped body or housing when it is configured to interconnect a single upper tubular string to two lower tubular strings. In a more general sense, and as used herein, however, the term "wye block" includes configurations in which two or more tubular strings are interconnected to another tubular string by the wye block body or housing. Additionally, the term "wye block" is not restricted to configurations in which a single tubular string extends in an upward direction therefrom and multiple tubular strings extend in a downward direction therefrom, although this may be the most commonly used configuration.

As stated above, the typical wye block provides fluid communication between the interconnected tubular strings via their attachment to the wye block body or housing. However, providing convenient access between each of the tubular strings is a far more difficult proposition. For example, if it is desired to convey a wireline tool or a coiled tubing string from the earth's surface into a certain one of the lower tubular strings, a device or mechanism should be provided in the wye block to direct the wireline tool or coiled tubing string from the upper tubular string, into the desired one of the lower tubular strings, and not into any other of the lower tubular strings. In addition, the device or mechanism should be capable of being repositioned when it is desired to permit access to another selected one of the lower tubular strings. Furthermore, the device or mechanism should not impede flow through the wye block during fluid production from the well, and should be reliable in operation, convenient to operate, and not subject to damage and deterioration during wellbore operations.

One proposed method of accomplishing these objectives is to construct the wye block with a diverter mechanism therein. The diverter mechanism may be a type of hinged flapper which, when positioned to one side in the wye block, will divert the tool or coiled tubing string toward a selected one of two lower tubular strings and, when positioned to the other side in the wye block, will divert the tool or coiled tubing string to the other lower tubular string. Openings may be provided in the flapper to permit fluid flow therethrough.

Unfortunately, such diverter mechanisms have several shortcomings. For example, the hinged flapper is subject to erosion and other deterioration, due to substantially constant fluid flow therethrough. Debris may accumulate about the diverter mechanism, preventing its subsequent operation. The openings formed through the flapper are typically not equivalent to a full bore opening. Only two lower tubular strings may be selected among by the diverter mechanism. In addition, a positive indication at the earth's surface is usually not available for determining whether the diverter mechanism has actually selected the desired lower tubular string for access thereto.

In view of the foregoing, it will be appreciated that a need exists for an improved wye block and improved methods of servicing wells in which multiple tubular strings are interconnected.

SUMMARY OF THE INVENTION

In carrying out the principles of the present invention, in accordance with an embodiment thereof, an improved wye block is provided in which a guide structure thereof is automatically aligned with a selected one of multiple tubular string connections. In a described method of servicing a subterranean well, the guide structure is separately conveyed as a part of an access control assembly into a housing assembly of the wye block after the wye block has been installed in the well interconnecting multiple tubular strings.

In one aspect of the present invention, the wye block housing assembly is installed in the well interconnecting multiple tubular strings. An access control assembly is then separately conveyed into the housing assembly when it is desired to access one of the tubular strings attached to the wye block housing assembly. The access control assembly includes a guide surface which is automatically aligned with a selected one of the tubular strings when the access control assembly is installed in the housing assembly.

In another aspect of the present invention, the access control assembly includes at least first and second portions. By securing the first portion relative to the second portion before the access control assembly is installed in the wye block housing assembly, the selected one of the tubular strings is determined before the access control assembly is conveyed into the well.

In still another aspect of the present invention, the access control assembly first portion engages an orienting device of the wye block housing assembly when the access control assembly is installed in the housing assembly. The orienting device may be a generally helically-shaped orienting profile, so that the access control assembly second portion is rotationally aligned with the selected one of the tubular strings when the access control assembly is installed in the housing assembly.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
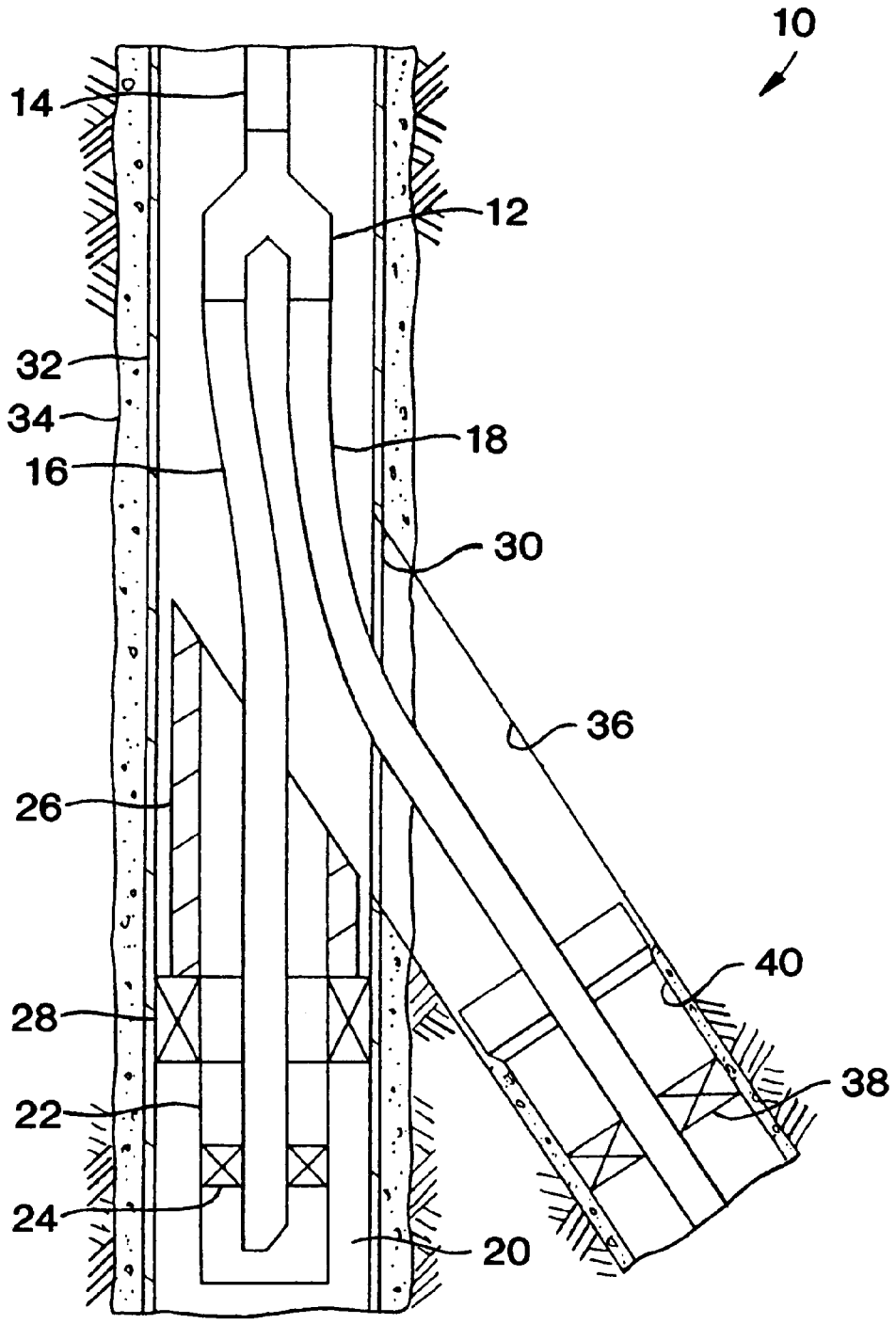
FIG. 1 is a schematicized view of a method of servicing a subterranean well embodying principles of the present invention.

Representatively illustrated in FIG. 1 is a method 10 of servicing a subterranean well, which method embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a wye block or access control apparatus 12 is installed in a well interconnecting an upper production tubing string 14 to two lower production tubing strings 16,18. The lower string 16 extends downwardly into a lower main or parent wellbore 20, wherein it is sealingly engaged within a tubular member 22 utilizing a packer 24. The tubular member 22 is attached to a hollow whipstock 26 sealingly engaged in the lower parent wellbore 20 via another packer 28.

The lower string 18 extends downwardly from the wye block 12 and laterally outwardly through a window 30 formed through casing 32 and cement 34 lining the parent wellbore. The lower string 18 extends into a branch or lateral wellbore 36 drilled outwardly from the window 30. A packer 38 provides sealing engagement between the lower string 18 and a liner 40 cemented within the lateral wellbore 36.

It will be readily appreciated that fluid produced from the lateral wellbore 36 may be flowed via the lower string 18 to the wye block 12, and that fluid from the lower parent wellbore 20 may be flowed via the lower string 16 to the wye block. From the wye block 12, the commingled fluids may be flowed through the upper string 14 to the earth's surface. Of course, these directions of fluid flow may be reversed if the strings 14, 16, 18 are utilized for injection rather than production of fluids.

It is to be clearly understood, however, that the method 10 is merely illustrative of the wide variety of methods of servicing a well and configurations of tubular strings and equipment therein which may embody principles of the present invention. For example, there may be more than two tubular strings attached to one end of the wye block 12, it is not necessary for one of the strings to extend into a lateral wellbore, it is not necessary for one of the strings to extend through a hollow whipstock, it is not necessary for the wye block to be configured or oriented as shown in FIG. 1, etc. Thus, it will be readily appreciated that other methods may be practiced, and many modifications may be made to the depicted method 10, without departing from the principles of the present invention.

In one unique aspect of the method 10, an access control assembly is conveyed into the wye block 12 after the wye block has been installed in the well interconnecting the tubular strings 14, 16, 18 and when it is desired to provide access to a selected one of the lower strings. In this manner, the access control assembly is not present in the wye block 12 when access to a particular one of the lower strings 16, 18 is not required. Thus, the access control assembly is not left in the wye block 12 to deteriorate, become fouled with debris, and block or restrict fluid flow through the wye block.

In another unique aspect of the method 10, the access control assembly is automatically aligned so that it permits access to the selected one of the lower strings 16,18 when it is installed in the wye block 12. In this manner, it is not necessary to engage the access control assembly with a wireline shifting tool or other tool downhole in order to align the access control assembly with the selected string. Instead, the access control assembly is appropriately configured at the earth's surface so that, when it is installed within the wye block 12, a guide structure of the access control assembly is automatically oriented to permit access to the selected string.

Figure 2A:
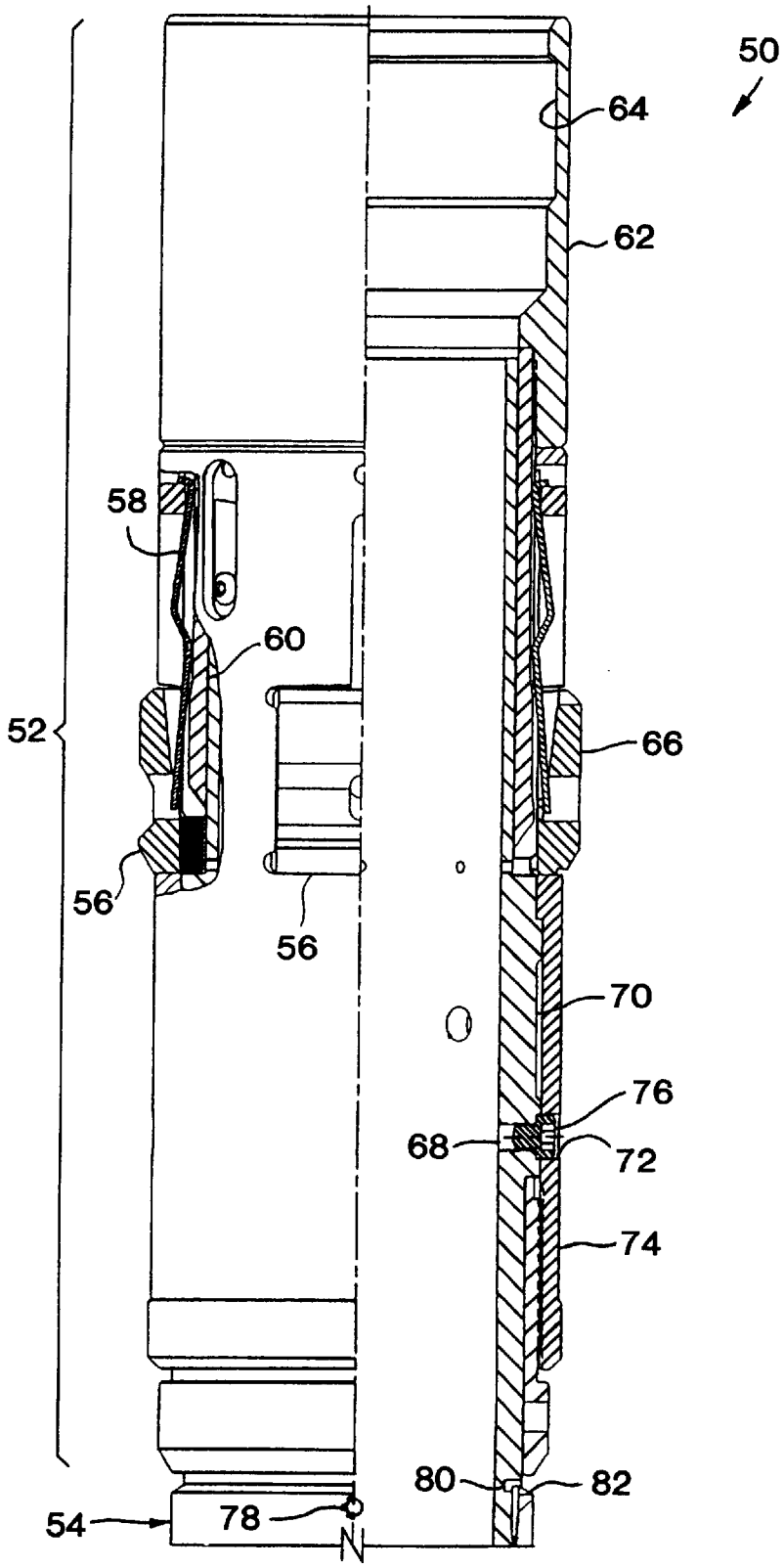
FIGS. 2A–2C are quarter-sectional views of successive axial sections of an access control assembly embodying principles of the present invention.
Figure 2B:
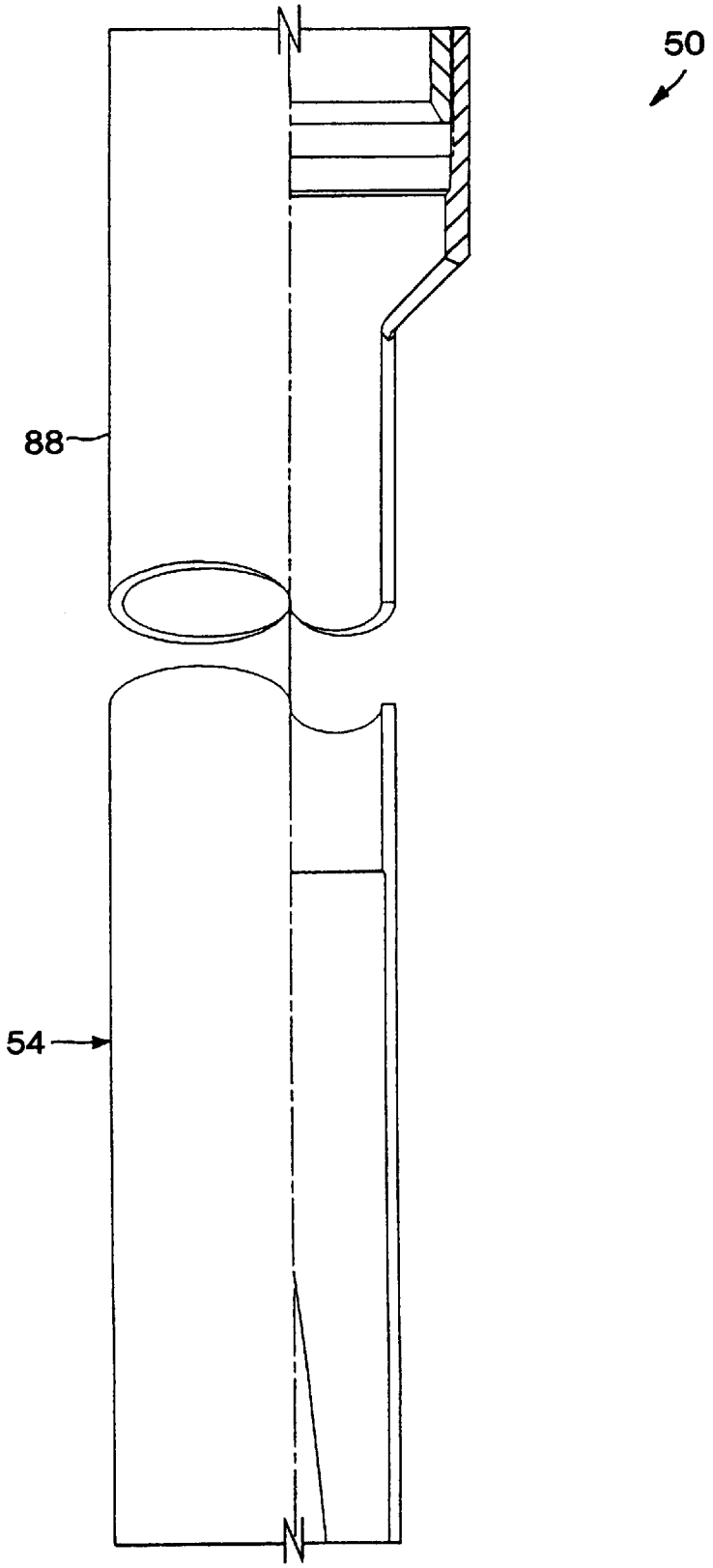
Figure 2C:
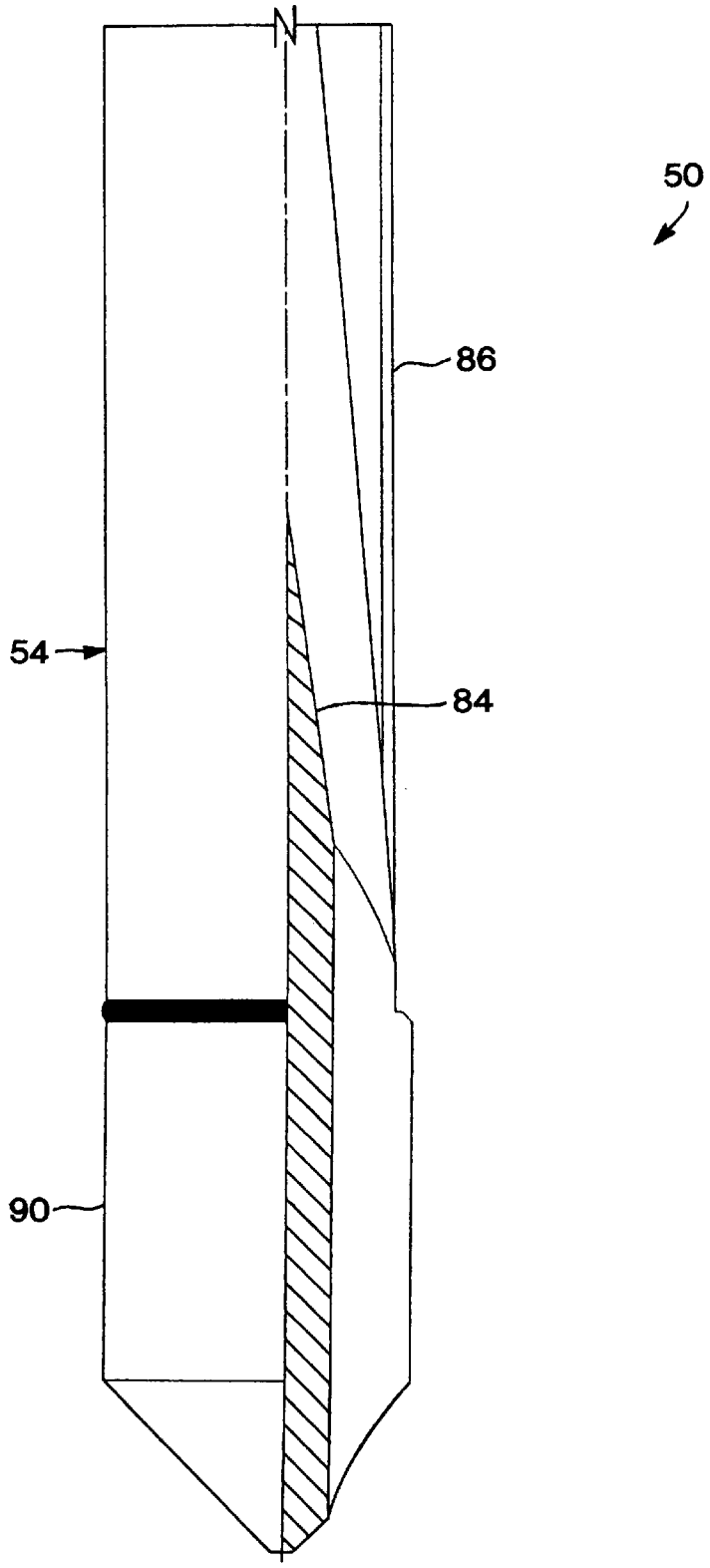

Referring additionally now to FIGS. 2A–2C, an access control assembly 50 embodying principles of the present invention is representatively illustrated. An orienting lock or upper portion 52 of the assembly 50 is utilized to releasably secure and rotationally orient the assembly within a wye block housing assembly described in further detail below. A guide or lower portion 54 of the assembly 50 is utilized to permit access to a selected string attached to the wye block housing assembly, and to exclude access to other strings attached to the wye block housing assembly. Of course, it is not necessary for the upper portion 52 to be above the lower portion 54, or for the access control assembly 50 to be otherwise constructed exactly as depicted in FIGS. 2A–2C, in keeping with the principles of the present invention.

The upper portion 52 includes a series of circumferentially spaced apart keys 56 which are biased outwardly by a corresponding set of springs 58. The keys 56 are shaped so that they will cooperatively engage a latching profile formed internally in the wye block housing assembly described below. An internal sleeve 60 maintains the keys 56 in engagement with the latching profile when the sleeve is in its downwardly disposed position as depicted in FIG. 2A. Note that the sleeve 60 is threadedly attached to a tubular upper connector 62 having an internal profile 64 formed therein so that, when it is desired to retrieve the assembly 50 from within the wye block housing assembly, the upper connector may be engaged by an appropriately configured retrieval tool (not shown) which displaces the upper connector and sleeve upwardly, thereby permitting the keys 56 to retract out of engagement with the wye block housing assembly and permitting the assembly to be retrieved from the well.

An orienting key 66 of the upper portion 52 is, however, not configured for cooperative engagement with the wye block housing assembly latching profile. Instead, the orienting key 66 is configured for engagement with an orienting profile of the wye block housing assembly, described more fully below. In a unique aspect of the present invention, the orienting key 66 is rotationally oriented relative to the lower portion 54 prior to conveying the assembly 50 into the wye block housing assembly.

To orient the key 66 relative to the lower portion 54, a threaded hole 68 formed through an inner tubular mandrel 70 is aligned with one of a series of circumferentially spaced apart openings 72 (only one of which is visible in FIG. 2A) formed through an outer sleeve 74. The key 66 extends outwardly through the sleeve 74. Thus, by installing a screw 76 in the opening 72 and threading it into the hole 68, the sleeve 74 is rotationally secured relative to the mandrel 70, thereby rotationally securing the key 66 relative to the mandrel.

The lower portion 54 is threadedly attached to the mandrel 70 and is rotationally secured relative thereto by means of one or more set screws 78. Before securement with the set screws 78, proper alignment of the lower portion 54 with the mandrel 70 is ensured by alignment of indicator marks or holes 80, 82 formed on the lower portion and mandrel.

It may now be seen that, by selecting an appropriate one of the openings 72 in which to install the screw 76, the lower portion may be conveniently rotationally oriented with respect to the key 66. For example, if it is desired to select from among two tubular string connections spaced 180 degrees apart in the wye block housing assembly for access thereto, two openings 72 may be correspondingly provided in the outer sleeve 74 spaced 180 degrees apart, so that the lower portion 54 may be oriented in either of two rotational positions spaced 180 degrees apart with respect to the key 66. If it is desired to select from among three tubular string connections spaced 120 degrees apart in the wye block housing assembly for access thereto, three openings 72 may be correspondingly provided in the outer sleeve 74 spaced 120 degrees apart, so that the lower portion 54 may be oriented in one of three rotational positions spaced 120 degrees apart with respect to the key 66. It will be readily appreciated that a wide variety of relative rotational orientations may be achieved by providing various numbers and spacings of the openings 72. In addition, it is to be clearly understood that methods of orienting the upper portion 52 relative to the lower portion 54 in keeping with the principles of the present invention are not limited to those representatively described herein, since they are given for illustrative purposes only. For example, instead of providing multiple spaced apart openings 72, multiple spaced apart threaded holes 68 could be provided, the key 66 could be selectively oriented with respect to the lower portion 54 by utilizing differently configured sleeves 74, mandrels 70, or combinations thereof, etc.

The lower portion 54 includes an inclined guide surface 84 formed in a guide structure 86 which has an upper generally tubular end 88 and a lower generally cylindrical end 90. The upper tubular end 88 is threadedly attached and rotationally secured to the upper portion 52 as described above. The lower end 90 is configured to be received within the wye block housing assembly as described below, in a manner restricting lateral displacement of the guide structure 86 relative to the wye block housing assembly. For this purpose, the lower end 90 has a generally conical shape, but may be otherwise configured without departing from the principles of the present invention.

Referring additionally now to FIGS. 3A–3E, a wye block or access control apparatus 100 embodying principles of the present invention is representatively illustrated. The wye block 100 may be utilized for the wye block 12 in the method 10 described above. Of course, the method 10 may be performed utilizing a wye block or access control apparatus other than the wye block 100, and the wye block 100 may be used in methods other than the method 10, without departing from the principles of the present invention.

As depicted in FIGS. 3A–3E, the wye block 100 has the access control assembly 50 operatively installed therein. When used in the method 10, it will be appreciated that the access control assembly 50 is not installed in a housing assembly 102 of the wye block 100 until it is desired to access a selected one of tubular strings attached to the housing assembly. Additionally, once such access is no longer desired, the assembly 50 may be retrieved from within the housing assembly 102, so that flow therethrough is not impeded, debris does not accumulate about the access control assembly, the access control assembly does not deteriorate, etc.

The orienting key 66 of the access control assembly 50 has engaged a generally helically-shaped orienting profile 104 in the housing assembly 102, thereby rotationally orienting the access control assembly 50 relative to the housing assembly. The orienting profile 104 is formed on a sleeve 106 secured within the housing assembly 102. When the access control assembly 50 is lowered into the housing assembly 102, the orienting key 66 engages the orienting profile 104 and rotates the access control assembly 50 relative to the housing assembly 102. Thus, the orienting key 66 and the orienting profile 104 may be considered portions of an overall orienting device for rotationally positioning the guide structure 86 relative to the housing assembly 102.

At the lower end of the orienting profile 104 a substantially vertical slot 108 receives the orienting key 66 and prevents further rotation of the access control assembly 50 within the housing assembly 102. At this time, the other keys 56 engage a cooperatively shaped internal latching profile 110 formed in the sleeve 106. The upper connector 62 and inner sleeve 60 of the access control assembly 50 are then displaced downwardly relative to the remainder of the upper portion 52, thereby securing the access control assembly within the housing assembly 102.

Figure 3A:
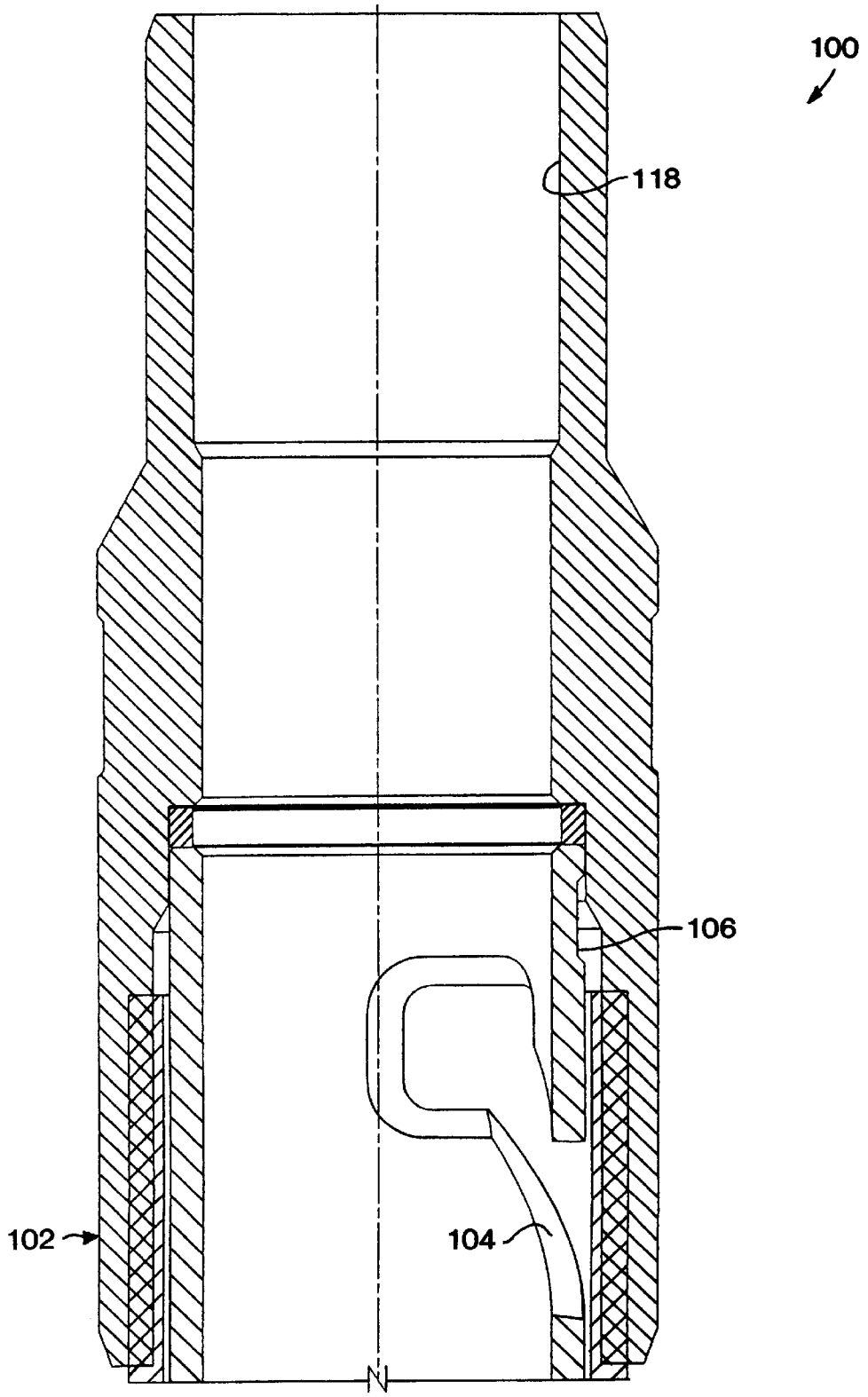
FIGS. 3A–3E are cross-sectional views of successive axial sections of an access control apparatus embodying principles of the present invention, a housing assembly thereof having the access control assembly of FIGS. 2A–2C installed therein.
Figure 3B:
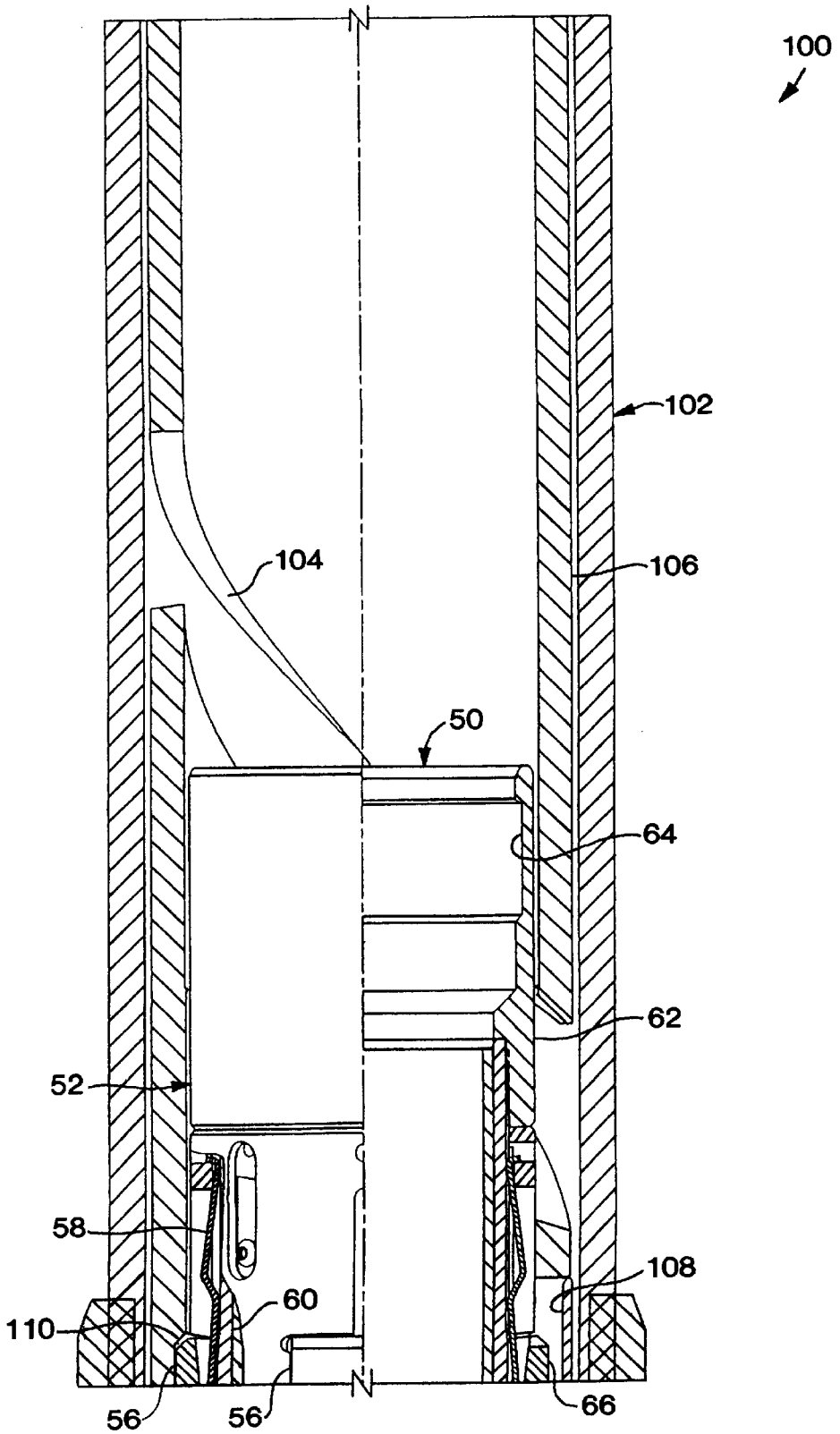
Figure 3C:
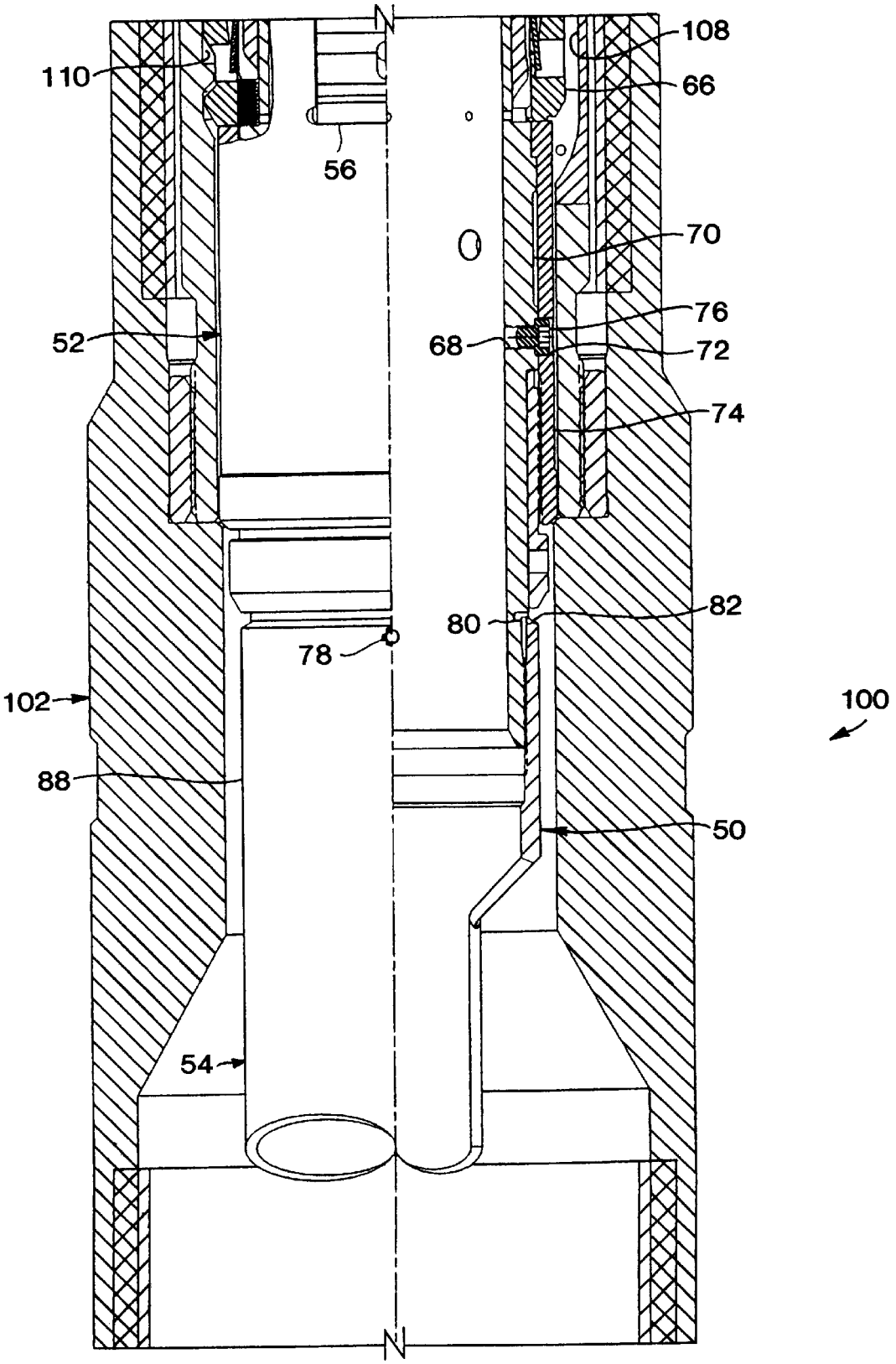
Figure 3D:
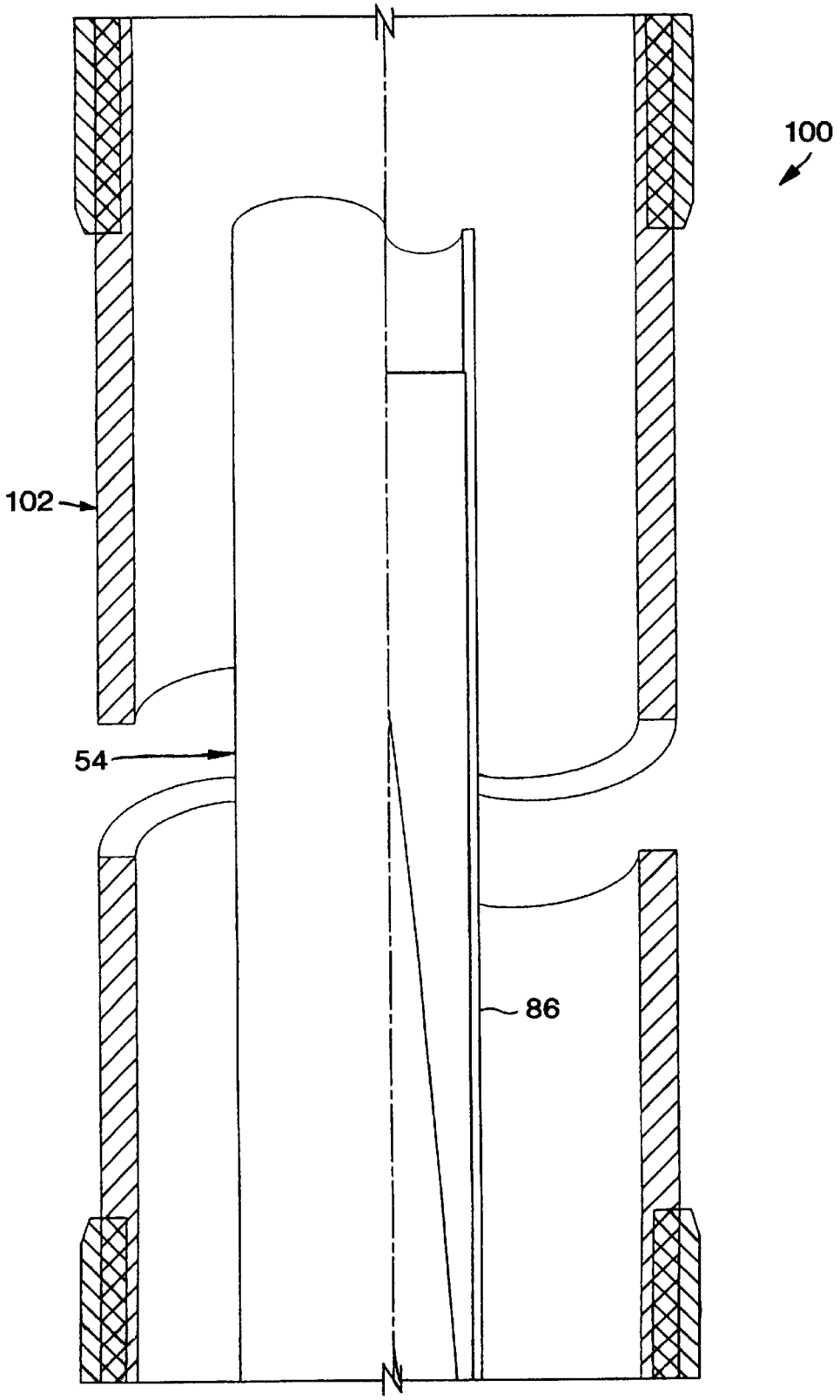
Figure 3E:
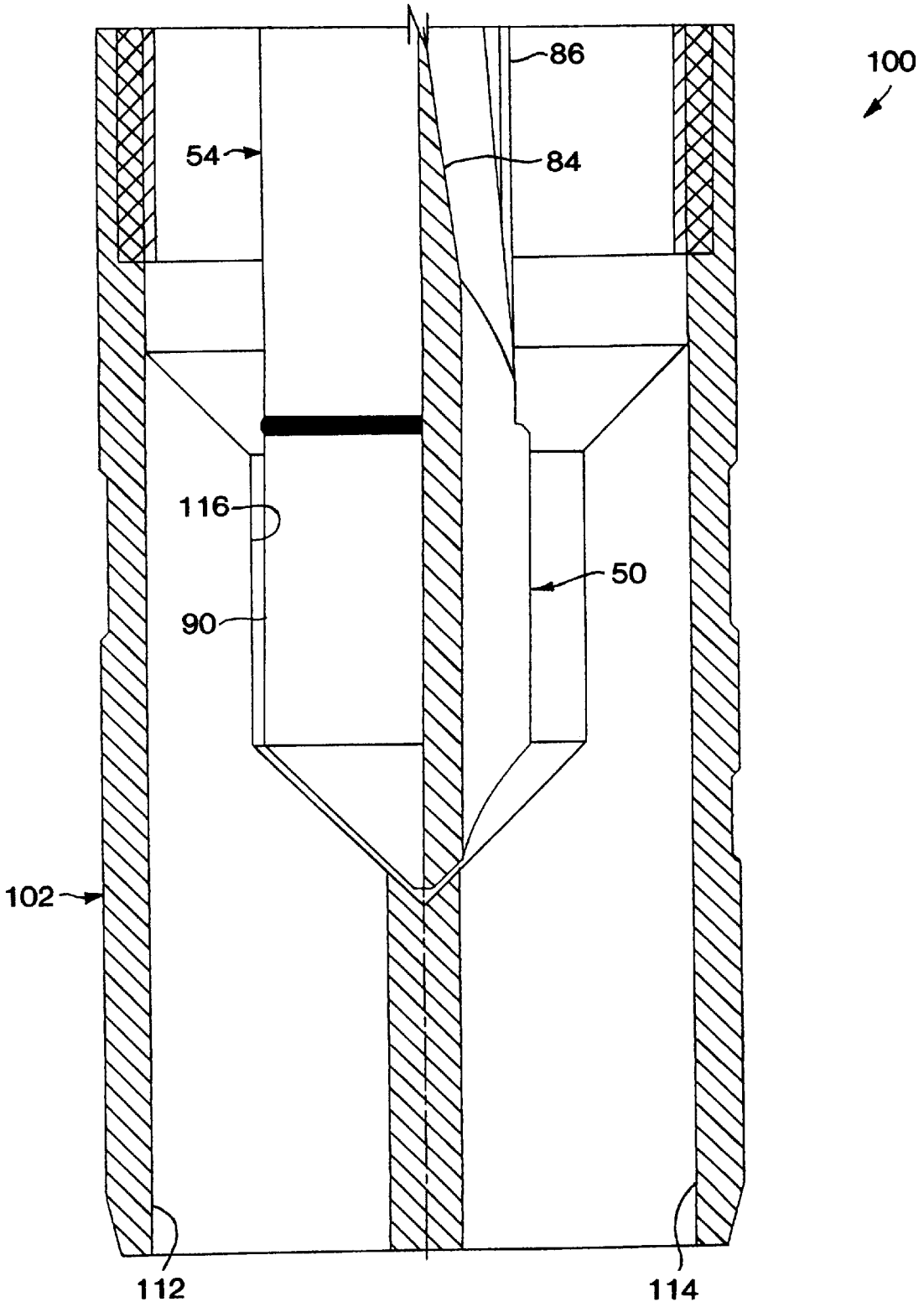

It may now be fully appreciated that, when the access control assembly 50 is operatively installed within the housing assembly 102, the guide structure 86 is automatically aligned with a selected one of two lower tubular string connections 112, 114 formed on the housing assembly. As shown in FIGS. 3D & 3E, the guide surface 84 is positioned to deflect a tool, equipment, etc. into the connection 114, while the remaining tubular portion of the guide structure 86 prevents access to the other connection 112. It will also be appreciated that, if the screw 76 were installed in another opening 72 spaced 180 degrees apart from the opening 72 shown in FIG. 3C, the guide surface 84 would be positioned to deflect a tool, equipment, etc. into the connection 112, while the remaining tubular portion of the guide structure 86 would prevent access to the other connection 114.

The lower end 90 of the guide structure 86 is received in a cooperatively shaped recess 116, thereby preventing undesirable lateral deflection of the guide structure 86 within the housing assembly 102, while permitting rotation of the access control assembly 50 as it is installed in the housing assembly.

At the upper end of the housing assembly 102, an upper tubular string connection 118 is provided. Each of the connections 112, 114, 118 may be provided with threads, seals, etc. as needed for interconnection of the wye block 100 to tubular strings in a well. For example, the upper connection 118 could be connected to the string 14, and the lower connections 112, 114 could be connected to the strings 16,18, in the method 10 described above.

Of course, many modifications, additions, substitutions, deletions and other changes to the specific embodiments of the present invention described above will be readily apparent to one skilled in the art upon consideration of the above description, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of servicing a subterranean well, the method comprising the steps of:

installing a wye block housing assembly in the well interconnecting at least first, second and third production tubing strings, the first tubing string extending to the earth's surface; and then separately conveying an access control assembly through the first tubing string and into the wye block housing assembly, thereby permitting access between the first tubing string and a selected one of the second and third tubing strings.

2. The method according to claim 1, further comprising the step of engaging the access control assembly with an orienting device of the housing assembly.

3. The method according to claim 2, wherein the engaging step further comprises rotationally aligning the access control assembly with respect to the housing assembly.

4. The method according to claim 2, wherein the engaging step further comprises aligning a guide surface of the access control assembly with the selected one of the second and third tubing strings.

5. The method according to claim 1, further comprising the step of configuring the access control assembly before the conveying step, so that, after the access control assembly is conveyed into the housing assembly, the access control assembly is automatically aligned with the selected one of the second and third tubing strings.

6. The method according to claim 5, wherein the configuring step comprises rotationally orienting a first portion of the access control assembly relative to a second portion of the access control assembly.

7. The method according to claim 6, further comprising the step of rotationally aligning the access control assembly second portion with the selected one of the second and third tubing strings by engaging the access control assembly first portion with the housing assembly after the conveying step.

8. A tubular string access control apparatus, comprising:

a housing assembly having an upper end and a lower end, the housing assembly being positionable in a well to interconnect at least first, second and third production tubing strings therein, the first tubing string extending to the earth's surface; and an access control assembly insertable through the first tubing string into the housing assembly upper end in a manner automatically aligning the access control assembly with a selected one of the second and third tubing strings in the housing assembly lower end to thereby permit access between the first tubing string and the selected one of the second and third tubing strings.

9. The apparatus according to claim 8, wherein the access control assembly is rotationally secured within the housing assembly, thereby permitting access between the housing assembly upper end and the selected tubular string connection.

10. The apparatus according to claim 8, wherein the access control assembly includes first and second portions, the first portion being securable relative to the second portion thereby determining the selected tubular string connection.

11. The apparatus according to claim 8, wherein the housing assembly includes an orienting device, and wherein the access control assembly engages the orienting device, thereby aligning the access control assembly with the selected tubular string, when the access control assembly is inserted into the housing assembly.

12. The apparatus according to claim 11, wherein the orienting device comprises an internal orienting profile.

13. The apparatus according to claim 12, wherein the access control assembly includes an engagement member configured to engage the orienting profile.

14. The apparatus according to claim 8, wherein the access control assembly is secured axially and rotationally within the housing assembly when the access control assembly is inserted into the housing assembly.

15. A method of servicing a subterranean well, the method comprising the steps of:

installing a wye block housing assembly in the well interconnecting at least first, second and third tubular strings;

conveying an access control assembly through the first tubular string and into the wye block housing assembly, the access control assembly including a guide rotationally secured with respect to an orienting lock, thereby preselecting one of the second and third tubular strings for access; and engaging the orienting lock with the wye block housing assembly, thereby permitting access between the first tubular string and the selected one of the second and third tubular strings.

16. The method according to claim 15, wherein the engaging step further comprises engaging a first engagement member of the orienting lock with an internal orienting profile of the housing assembly.

17. The method according to claim 16, wherein in the engaging step, the first engagement member is rotated relative to the housing assembly as the access control assembly is conveyed into the housing assembly.

18. The method according to claim 16, wherein the engaging step further comprises engaging a second engagement member of the orienting lock with an internal locking profile of the housing assembly.

19. The method according to claim 18, wherein in the engaging step, engagement between the second engagement member and the locking profile releasably secures the access control assembly axially within the housing assembly.

20. The method according to claim 19, wherein in the engaging step, engagement between the second engagement member and the locking profile prevents relative rotation between the access control assembly and the housing assembly.

21. The method according to claim 15, further comprising the step of rotationally securing the guide with respect to the orienting lock prior to the conveying step.

22. A method of servicing a subterranean well, comprising the steps of:

rotationally securing a first portion of an orienting device to a guide;

installing a second portion of the orienting device in the well as a part of a wye block housing assembly; and then installing the guide in the wye block housing assembly previously installed in the well, the orienting device first and second portions engaging and automatically aligning the guide with a selected one of multiple tubular strings attached to the wye block housing assembly.

23. The method according to claim 22, wherein in the guide installing step, the orienting device second portion comprises an internal orienting profile disposed within the housing assembly.

24. The method according to claim 23, wherein in the securing step, the orienting device first portion comprises an engagement member configured for cooperative engagement with the orienting profile.

25. The method according to claim 22, wherein in the guide installing step, the one of the multiple tubing strings is preselected when the guide is rotationally secured relative to the orienting device first portion.

26. The method according to claim 22, wherein in the securing step, the guide and orienting device first portion are parts of an access control assembly, and wherein in the guide installing step, the guide permits access to the selected tubular string.

27. The method according to claim 26, wherein in the guide installing step, the guide prevents access to one or more tubular strings other than the selected tubular string.

* * * * *